US005244156A

United States Patent [19]

Mendenhall et al.

[11] Patent Number: 5,244,156

[45] Date of Patent: Sep. 14, 1993

[54] METHOD TO REDUCE THE DUSTINESS OF EXTRAFINE COBALT POWDER

[75] Inventors: Robert G. Mendenhall, Elmira, N.Y.; Michael J. Miller, Towanda, Pa.

[73] Assignee: GTE Products Corporation, Danvers, Mass.

[21] Appl. No.: 616,976

[22] Filed: Nov. 20, 1990

[51] Int. Cl.[5] ..... B02C 19/12

[52] U.S. Cl. ..... 241/30

[58] Field of Search ..... 75/365; 241/23, 30, 241/24, 5

[56] References Cited

U.S. PATENT DOCUMENTS 3,994,716 11/1976 Huppmann et al. ..... 75/365 X 4,395,278 7/1983 Vanderpool et al. ..... 75/365

*Primary Examiner*—Mark Rosenbaum

*Assistant Examiner*—Kenneth J. Hansen

*Attorney, Agent, or Firm*—Robert E. Walter; Elizabeth A. Levy

[57] ABSTRACT

In a process for reducing the dust content of cobalt metal powder, the starting cobalt powder containing dust is milled for a sufficient period of time to increase the bulk density and decrease the dust content while substantially maintaining the original Fisher Sub Sieve Size.

10 Claims, No Drawings

METHOD TO REDUCE THE DUSTINESS OF EXTRAFINE COBALT POWDER

BACKGROUND OF THE INVENTION

The present invention is directed to the process for reducing the dust content of extrafine cobalt powder.

Extrafine pure cobalt metal powder is typically produced by the reduction of a cobalt hydroxide precipitate. Such pure cobalt powder has a tendency to include a cobalt dust portion. The dust is in the form of cobalt fines which tend to become airborne when the cobalt powder is transported such as pouring cobalt powder from one container to another.

U.S. Pat. No. 4,469,505 to Cheresnowsky et al relates to a process where a cobalt hydroxide precipitate is heat treated prior to reduction at a selected temperature for reducing the Fisher Sub Sieve Size of the finely produced metal powder. Screening the cobalt powder to obtain a powder of predetermined size is also disclosed. Screening through a 100 mesh size screen to is disclosed. Extrafine cobalt metal powder preferably has Fisher Sub Sieve Size less than 1.5.

Heretofore, efforts to control the particle size of finely produced extra fine pure cobalt metal powder were directed to enhancements of the chemical process for preparing the powder and techniques for sieving the finally produced powder.

SUMMARY OF THE INVENTION

The present invention is directed to reducing dust content of extra fine pure cobalt metal powder by treating the finally produced powder without separating the dust portion from the remaining powder. Separation of the dust portion to obtain cobalt powder having a low dust portion reduces the total yield of cobalt powder and is undesirable from an economic standpoint. Heretofore, efforts to control particle size would not necessarily result in controlling the dust portion of the cobalt extrafine powder.

In accordance with the present invention there is provided a process for reducing the dust content of extrafine pure cobalt metal powder comprising milling said cobalt powder for a sufficient period of time to increase the bulk density of the said powder whereby the dust content of the powder is decreased.

DETAILED DESCRIPTION

The present invention uses starting powders of cobalt which are relatively pure. Such powders are typically prepared by the reduction of cobalt hydroxide precipitate as set forth in the U.S. Pat. No. 4,469,505 to Cheresnowsky and other patents as set forth in the '505 patent. Such powders are typically prepared by the hydrogen reduction of a relatively pure cobalt hydroxide to give a pure cobalt starting powder. Cobalt powders are typically obtained by chemical reduction of cobaltic hydroxide or cobalt oxide hydrate by hydrogen at elevated temperatures.

Pure metal cobalt powder preferably has a Fisher Sub Sieve Size of less than about 2 and more preferably less than about 1.5. More preferably the screen size is 100 mesh since −100 mesh cobalt makes a good powder for cemented carbides if Fisher Sub Sieve Size is 1.50 or less.

The Fisher Sub Sieve Size is a unitless measure of particle size which has gained industrial acceptance. The Sub Sieve apparatus is available commercially from Fisher Scientific Company for taking advantage of the air-permeability method. The method is based on the relation between specific surface of packed particles and their permeability [Caeman, J. Soc. Chem Inc. (London) 57,225(1938)]. The air permeability method relates to average particle size and does not give particle size distribution.

Extrafine pure cobalt metal powder may contain a dust portion which has a tendency to become airborne under certain conditions. Such conditions may be created in a laboratory setting and the relative dust content of cobalt metal powders compared. One such apparatus for dust measurement comprises a chamber for receiving a powder charge of the cobalt to be tested. By imparting a vibrating motion to the particles inside the chamber and drawing a current of air through the powder, particles of dust become entrained in the air or airborne. The entrained dust may be conveniently collected on a filter. By subjecting different lots of powder to the same conditions, powders having a greater amount of dust content will result in a greater accumulation of cobalt on the filter. By determining the amount of cobalt dust accumulation, a relative measurement of the dust content can be obtained. The vessel is set up much as a fluidized bed wherein a current is drawn through the bed with particles of dust settling out on a filter. For powders having measured dust content on the order of 5 percent of the total weight of the cobalt powder, it has been found that utilization of the present invention can reduce the dust content to less than about 1 percent by weight.

In accordance with principles of the present invention, pure metal cobalt powder having a predetermined dust content is treated by subjecting the powder to shear stress by milling to reduce the dust content. Preferably the dust content is reduced by about 50% by weight, and more preferably the dust content is reduced by about 75% by weight as measured by the above technique. It has been found that pure metal cobalt powders having an undesirable dust content have a bulk density less than one. Milling powders having such low bulk density in accordance with the present invention results in an increase in the bulk density. Preferably the final milled pure cobalt metal powder has a bulk density greater than 1 and more preferably greater than 1.1, and most preferably greater than 1.2 where the density is measured in grams/cubic centimeter.

Generally milling processes result in a size reduction of the powder milled. Hence, it would be expected that the dust content of the powder would increase by milling. Contrary to that expectation, the dust content of the extra fine cobalt metal powder is reduced by milling. Typical techniques for milling include ball milling, attritor milling, and fluid energy milling. In fluid energy milling or jet milling a stream of gas containing the powder to be milled is impinged against a fixed target or other particles. In ball milling the powder to be milled is placed in a rotating container with a grinding medium such as balls or rods. In attritor milling, powder particles are subjected to a shearing force by contacting other particles which are in motion. An attritor mill may include a rotating disk or blade which moves through the charge, milling media and cobalt metal powder charge, so as to impart energy to the material. Attritor milling generally results in more energy being imparted during milling and results in faster milling times as compared to ball milling. Dry milling is preferred but it is contemplated that wet milling may be utilized provided oxidation of the cobalt powder is prevented when the milling fluid is removed. In the present invention, the amount of dust is reduced but the original Fisher Sub Sieve Size is substantially maintained.

Attritor milling is the preferred milling technique for imparting a shearing force to the fine metal cobalt powder to achieve a reduction of the dust content. The attritor mill utilized employs a cylindrical container having a round bottom and a removable lid. The outer wall is symmetrical about a central axis. A rotating vertical shaft can be lowered into the cylindrical milling vessel along the central axis. A blade projects outwardly from the bottom of the shaft. When the shaft is positioned in the vessel the blade is closely adjacent the bottom of the vessel. The blade is sufficiently close to the floor of the vessel so that fine metal cobalt particles passing between the blade and the floor of the vessel are subjected to shear. As the shaft is rotated, cobalt powder in the vessel tends to circulate in the vessel and to flow around the blade.

In accordance with the preferred embodiments of the preferred invention, the cobalt metal powder is preferably milled until the bulk density is greater than 1 gram per cubic centimeter. It is normally expected that a milling process would break up particles and perhaps make it more dusty. The technique of the present invention has reduced the dustiness of the cobalt powder.

EXAMPLE

The dust content of a pure cobalt metal powder is measured in an apparatus as described above. The apparatus comprises chamber for receiving a powder charge of the cobalt to be tested, means for imparting a vibrating motion to the particles inside the chamber, and means for drawing a current of air through the powder particles to entrain in the air. The entrained dust is conveniently collected on a filter. The vessel is set up much as a fluidized bed wherein an air current is drawn through the bed with particles of dust settling out on a filter. The pure metal cobalt powder is charged to the vessel in 25 grams lots. The vibrating bed is subjected to a vacuum at 20 inches of mercury on a gage. The air stream passing through the bed is exhausted through a filter over a preset incremental period of time. The amount of dust collected is reported in Table 1 in grams under the heading Dust. Note that the unmilled powder had a dust content of 4.6 grams. The relative dustiness of cobalt powder is reported and measured in the Table. In processing the dusty cobalt powder to reduce the dust content the lots of the dusty powder are processed in the attritor mill. The mill is of the type previously described. The rotatable shaft as previously described is lowered into the cylindrical milling vessel along the central axis. Directly above the blade a pair of prongs project outwardly from the shaft. The prongs are arranged in a staggered fashion about ¼ of an inch above the blade. The milling media in the form of tungsten carbide balls are of the size reported in the Table. The blade is sufficiently close to the floor of the vessel so that the balls do not flow between the blade and the floor of the vessel. As the shaft is rotated, cobalt powder in the vessel tends to flow around the blade. The agitator blade moves both milling media (WC) and cobalt metal powder. The attritor mill as previously described has a vessel of about 6 inches in diameter by about 6 inches in height. About 2.3 kilograms of tungsten carbide balls having a diameter set forth are milling media. About 300 grams of cobalt extrafine powder having a Fisher Sub Sieve Size of 1.30 and a dustiness of 4.6 and density of 0.78 is added to the vessel. A nitrogen purge lid is utilized for a top of the vessel. The nitrogen purge through the vessel are to prevent oxidation of the cobalt and is at the rate of 5 F standard C cubic F feet p per H hour (FCFH). Eight lots of the dusty powder were processed in the attritor mill for the time periods, with the ball sizes, at the agitator speeds, set forth in Table 1. The dust content of the resulting milled powders were measured as set forth above and reported in Table 1 under dust. From the Table it can be seen that the dust as measured in grams obtained on the filter was reduced from the high of the unmilled powder to a low level of dust content after milling as reported in Runs 5 and 6.

TABLE I

| Std. No. | Ball Size (in.) | Agitator Speed (RPM) | Time (MIN) | Dust (g) | Bulk FSSS | Bulk Density (g/cc) |
|---|---|---|---|---|---|---|
| 1 | 0.125 | 150 | 1 | 3.2 | 1.28 | 0.84 |
| 2 | 0.250 | 150 | 1 | 3.8 | 1.31 | 0.88 |
| 3 | 0.125 | 200 | 1 | 2.8 | 1.30 | 0.89 |
| 4 | 0.250 | 200 | 1 | 3.3 | 1.20 | 0.93 |
| 5 | 0.125 | 150 | 15 | 0.41 | 1.31 | 1.17 |
| 6 | 0.250 | 150 | 15 | 0.28 | 1.29 | 1.33 |
| 7 | 0.125 | 200 | 15 | 1.0 | 1.28 | 1.20 |
| 8 | 0.250 | 200 | 15 | 1.5 | 1.32 | 1.21 |
| Unmilled | | | | 4.6 | 1.30 | 0.78 |

What is claimed:

1. A process for reducing the dust content of extrafine pure cobalt metal powder comprising milling said cobalt powder for a sufficient period of time to increase the bulk density and reduce the dust content of said extrafine pure cobalt metal powder.

2. A process according to claim 1 wherein the milling process is performed in an attritor mill containing milling media.

3. A process according to claim 2 wherein the milling process is by dry milling.

4. A process according to claim 3 wherein said extrafine pure cobalt metal powder has a Fisher Sub Sieve Size of less than about 2.

5. A process according to claim 4 wherein the resulting cobalt metal powder has a Fisher Sub Sieve Size substantially equal to the Fisher Sub Sieve Size of the starting cobalt metal powder and a bulk density greater than that of said starting cobalt metal powder.

6. A process for reducing the dust content of extrafine pure cobalt metal powder having a bulk density of less than one gram per cubic centimeter, comprising the step of milling said extrafine pure cobalt metal powder for a sufficient period of time to increase the bulk density thereof to greater than one gram per cubic centimeter.

7. A process according to claim 6 wherein said bulk density of said extrafine pure cobalt metal powder is increased to greater than 1.1 grams per cubic centimeter.

8. A process according to claim 6 wherein said bulk density of said extrafine pure cobalt metal powder is increased to greater than 1.2 grams per cubic centimeter.

9. A process according to claim 6 wherein said dust content of said extrafine pure cobalt metal powder is reduced by about 50% by weight.

10. A process according to claim 6 wherein said dust content of said extrafine pure cobalt metal powder is reduced by about 75% by weight.

* * * * *